US006151814A

United States Patent [19]

Raio et al.

[11] Patent Number: 6,151,814

[45] Date of Patent: Nov. 28, 2000

[54] MANUAL HEAT PRESS MACHINE

[75] Inventors: Steven M. Raio; John J. Boyer, both of Yorba Linda; Jesus Mendoza, Downey; Harry Springer, III, Cypress, all of Calif.

[73] Assignee: Insta Grahic Systems, Cerritos, Calif.

[21] Appl. No.: 09/291,539

[22] Filed: Apr. 14, 1999

Related U.S. Application Data

[63] Continuation-in-part of application No. 09/225,032, Jan. 4, 1999.

[51] Int. Cl.[7] ..... D06F 71/08

[52] U.S. Cl. ..... 38/30

[58] Field of Search ..... 38/28, 30, 42, 38/43, 35, 34; 425/149, 150

[56] References Cited

U.S. PATENT DOCUMENTS

| | | | |
|---|---|---|---|
| 1,340,522 | 5/1920 | Capman | 38/30 |
| 1,656,893 | 1/1928 | Clisson | 38/43 |
| 1,883,863 | 10/1932 | Baker | 38/30 |
| 1,967,084 | 7/1934 | Emery | 38/30 |
| 2,037,551 | 4/1936 | Visscher | 38/34 |
| 2,071,187 | 2/1937 | Watts | 38/30 |
| 3,068,778 | 12/1962 | Majerus | 99/375 |
| 3,108,533 | 10/1963 | Read et al. | 100/98 |
| 3,565,015 | 2/1971 | Jorgensen | 107/15 |
| 3,761,216 | 9/1973 | Duarte et al. | 425/214 |
| 3,814,005 | 6/1974 | Widdel | 99/349 |
| 3,844,701 | 10/1974 | Rockwell | 425/348 |
| 3,947,204 | 3/1976 | Ayres et al. | 425/383 |
| 4,060,365 | 11/1977 | Duarte et al. | 425/214 |
| 4,303,677 | 12/1981 | De Acetis | 426/27 |
| 4,417,867 | 11/1983 | Bauer | 425/394 |
| 4,508,025 | 4/1985 | Schultz | 99/353 |
| 4,511,324 | 4/1985 | Bauer | 425/398 |
| 4,559,002 | 12/1985 | Atwood | 425/152 |
| 4,634,365 | 1/1987 | Triporo et al. | 425/398 |
| 4,874,454 | 10/1989 | Talalay et al. | 156/359 |
| 4,973,240 | 11/1990 | Reilly | 425/195 |
| 4,989,508 | 2/1991 | King | 101/35 |
| 5,019,193 | 5/1991 | Aramini | 156/64 |
| 5,135,036 | 8/1992 | Caron | 144/286 |
| 5,147,661 | 9/1992 | Kurumaji et al. | 425/150 |
| 5,156,782 | 10/1992 | Ballantyne | 264/40 |
| 5,170,704 | 12/1992 | Warren et al. | 101/41 |
| 5,244,529 | 9/1993 | Siegel | 156/384 |
| 5,282,732 | 2/1994 | Eggert | 425/153 |
| 5,296,081 | 3/1994 | Morin et al. | 156/498 |
| 5,417,149 | 5/1995 | Raio et al. | 99/349 |
| 5,469,779 | 11/1995 | Amore et al. | 99/349 |
| 5,800,844 | 9/1998 | Raio et al. | 425/150 |

OTHER PUBLICATIONS

Doughpro 6000 series advertisement.
Doughpro model DP 1100 advertisement.
Doughpro model DP 1800 advertisement.
Doughrpo model DP 1400 advertisement.

*Primary Examiner*—Ismael Izaguirre
*Attorney, Agent, or Firm*—Stetina Brunda Garred & Brucker

[57] ABSTRACT

A manually actuated heat press machine for applying a heat transfer to a substrate. The machine comprises a housing having a lower platen attached thereto. Pivotally connected to the housing is an actuation handle which is selectively moveable between a press position and a release position relative thereto. Attached to the actuation handle is an upper platen which is reciprocally movable toward and away from the lower platen thereby. The upper platen is attached to the actuation handle so as to be in substantial alignment with and in spaced relation to the lower platen. Cooperatively engaged to the housing and to the upper platen is a linkage mechanism for maintaining the upper platen in substantial alignment with the lower platen when the actuation handle is moved between its press and release positions.

19 Claims, 3 Drawing Sheets

MANUAL HEAT PRESS MACHINE

CROSS-REFERENCE TO RELATED APPLICATIONS

The present application is a continuation-in-part of U.S. application Ser. No. 09/225,032 entitled MANUAL HEAT PRESS MACHINE filed Jan. 4, 1999, the disclosure of which is incorporated herein by reference.

BACKGROUND OF THE INVENTION

The present invention relates generally to devices for applying graphics to wearing apparel, and more particularly to a manually actuated heat press machine for use in applying heat transfers to wearing apparel and including an adjustment mechanism for selectively increasing or decreasing the level of compressive pressure exerted thereby.

It is a common practice in the wearing apparel industry to apply decals commonly referred to as heat transfers to various items of wearing apparel, and most notably T-shirts. Heat transfers typically comprise decorative indicia or ornamental matter in the form of a generally planar sheet which is either impregnated with a thermoset material or has such thermoset material applied to one side or face thereof. The application process is typically accomplished by placing the heat transfer onto the item of wearing apparel or other substrate. As will be recognized, if the heat transfer includes a layer of thermoset material applied to one side thereof, the side having the thermoset material applied thereto is placed into direct contact with the substrate. Thereafter, compressive pressure is applied to the heat transfer concurrently with a relatively high level of heat. The combination of heat and compressive pressure facilitates the adhesion of the heat transfer to the substrate.

During the application process, it is critical that the proper amount of compressive pressure be applied to the heat transfer. In this respect, if the level of applied compressive pressure is excessive, the typical result is that the heat transfer is smashed into the substrate. As will be recognized, such "smashing" in turn results in the irreparable distortion of the heat transfer, and consequently the ruining of the substrate due to the inability to remove the heat transfer therefrom. Conversely, if the level of applied compressive pressure is insufficient, the typical result is that the heat transfer does not properly adhere to the substrate. Such lack of adhesion usually results in the heat transfer peeling or falling off the substrate either immediately or shortly thereafter, such as during a laundry cycle.

There is currently known in the prior art various manual and automatic devices for facilitating the application of a heat transfer to a substrate. However, these prior art devices possess certain deficiencies which detract from their overall utility. More particularly, currently known manual devices typically lack the capacity to allow the level of compressive pressure applied to the substrate thereby to be selectively adjusted. Such adjustability is highly desirable in that the proper level of compressive pressure to be applied by the device is often a function of the thickness of the particular substrate to which the heat transfer is to be applied. Though some prior art manually operated devices include mechanisms to facilitate a pressure adjustment, such devices do not provide a way to accurately gauge the level of compressive pressure being applied thereby, with variances from machine to machine requiring that the operator of a particular machine learn the nuances thereof. These drawbacks are also found in prior art automatic devices, including those which are pneumatically controlled or operated.

The manually actuated or operated heat press machine described in the parent application addresses the shortcomings of these prior art devices due to its inclusion of an adjustment mechanism for allowing the compressive pressure applied thereby to be selectively raised or lowered to a desired level with a high degree of accuracy during the process of applying a heat transfer to a substrate. Though providing numerous advantages over the prior art, Applicant has determined that there is a susceptibility for the upper platen of its heat press machine as described in the parent application to move forwardly relative to the lower platen when the actuation handle thereof is moved between its press and release positions. As will be recognized, such heat press machine of the Applicant would provide even greater advantages over prior art devices if the same were to be configured such that the upper platen thereof was maintained in substantial alignment with the lower platen at all times during the movement of the actuation handle between its press and release positions, since the forward movement of the upper platen upon the movement of the actuation handle to its press position could have an adverse effect on the process of applying the heat transfer to the substrate. The present invention addresses this further need by providing a linkage mechanism which is added to Applicant's heat press machine as described in the parent application and effectively maintains the upper platen in substantial alignment with the lower platen during movement of the actuation handle between its press and release positions.

BRIEF SUMMARY OF THE INVENTION

In accordance with the present invention, there is provided a manually actuated or operated heat press machine for applying a decal or graphic, and more particularly a heat transfer, to a substrate. These substrates typically comprise wearing apparel, and most notably garments such as T-shirts, shirts, and sweatshirts. However, the present heat press machine may also be used to apply heat transfers to other substrates, including towels, hand towels, hats and visors. Typically, any substrate with which the present heat press machine is utilized will be fabricated from a cloth or fabric material of natural or synthetic fibers.

The manual heat press machine of the present invention preferably comprises a housing having a lower platen attached thereto. Pivotally connected to the housing is an elongate actuation handle which is selectively movable between a press position and a release position relative to the housing. Attached to the actuation handle is an upper platen which is reciprocally movable by the actuation handle toward and away from the lower platen. The upper platen is substantially aligned with and disposed in spaced relation to the lower platen when the actuation handle is in its press position. In the preferred embodiment, the upper and lower platens of the heat press machine each have generally square configurations, with the lower platen defining a generally planar top surface and the upper platen defining a generally planar bottom surface. Additionally, the housing of the heat press machine is preferably configured such that the upper platen and the actuation handle are pivotally moveable between an operating position and an access position relative to the lower platen. In this respect, the upper platen is substantially aligned with the lower platen when in the operating position.

The heat press machine of the present invention further comprises a linkage mechanism which is cooperatively engaged to the housing and to the upper platen for maintaining the upper platen in substantial alignment with the lower platen when the actuation handle is moved between its press and release positions. The linkage mechanism preferably comprises an identically configured pair of elongate strut members having first ends which are pivotally connected to the housing and second ends which are pivotally connected to the upper platen, and more particularly to an anchor member attached to and extending upwardly from the top surface of the upper platen. The strut members are maintained in spaced, generally parallel relation to each other during movement of the actuation handle between its press and release positions.

The present heat press machine further comprises an adjustment mechanism which is preferably disposed within the housing and is mechanically coupled to the actuation handle for selectively adjusting the spacing between the upper and lower platens when the actuation handle is in its press position. The adjustment mechanism preferably comprises a first wedge member which is movably attached to the housing and selectively movable along a first, generally vertically oriented axis relative thereto. In addition to the first wedge member, the adjustment mechanism includes a second wedge member which is movably or slidably attached to the housing and selectively movable along a second, generally horizontally oriented axis relative thereto which extends in generally perpendicular relation to the first axis. The adjustment mechanism also includes an elongate linkage member, one end of which is pivotally connected to the first wedge member, with the opposite end being pivotally connected to the actuation handle.

In the present heat press machine, the first and second wedge members of the adjustment mechanism are oriented relative to each other such that the movement of the second wedge member along the second axis results in the concurrent movement of the first wedge member along the first axis. More particularly, the movement of the second wedge member along the second axis toward the first wedge member results in the upward movement of the first wedge member along the first axis and a decrease in the spacing between the upper and lower platens. Conversely, the movement of the second wedge member along the second axis away from the first wedge member results in the downward movement of the first wedge member along the first axis and an increase in the spacing between the upper and lower platens. In the present heat press machine, a decrease in the spacing between the upper and lower platens effectively increases the level of compressive pressure applied by the upper platen to any substrate and heat transfer between the upper and lower platens when the actuation handle is moved to the press position. An increase in the spacing between the upper and lower platens effectively decreases the level of compressive pressure applied by the upper platen to any substrate and heat transfer between the upper and lower platens when the actuation handle is moved to the press position.

In the preferred embodiment, the second wedge member of the adjustment mechanism preferably includes an elongate adjustment handle which is attached thereto and extends therefrom so as to protrude from the housing. The adjustment handle is used to facilitate the movement of the second wedge member back and forth along the second axis. Additionally, the housing preferably includes indexing indicia disposed thereon adjacent that portion of the adjustment handle which protrudes therefrom for providing a visual reading which is correlated to the spacing between the upper and lower platens. The upper platen is preferably provided with a heating element, which may also be included in the lower platen as well.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
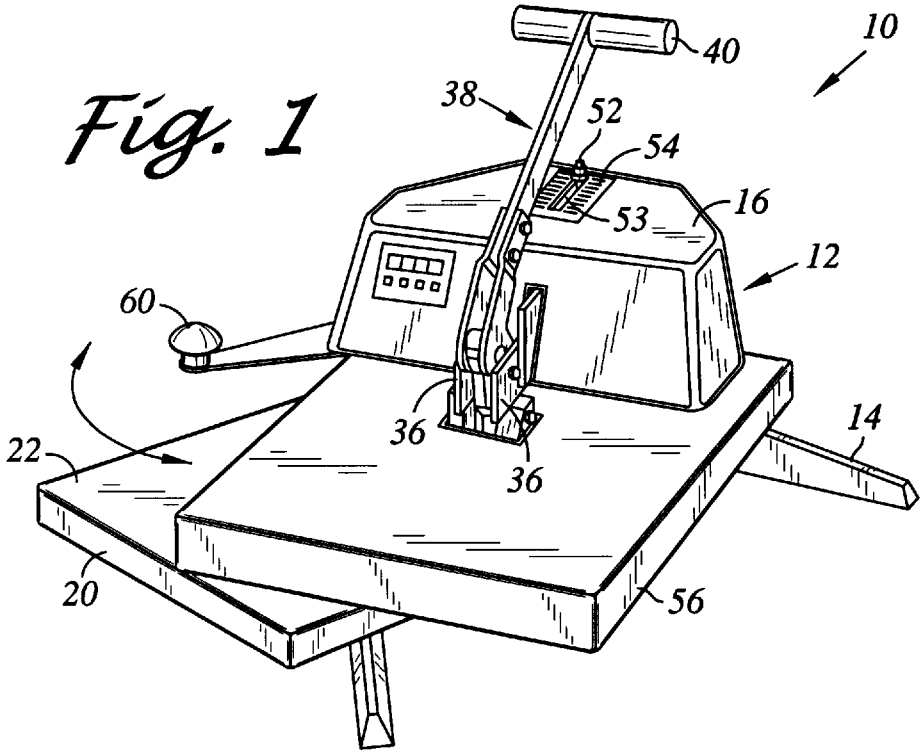
FIG. 1 is a front perspective view of a heat press machine constructed in accordance with the present invention.

Referring now to the drawings wherein the showings are for purposes of illustrating a preferred embodiment of the present invention only, and not for purposes of limiting the same, FIG. 1 perspectively illustrates the manually actuated or operated heat press machine 10 constructed in accordance with a first embodiment of the present invention which is used for applying a decal or graphic, and more particularly a heat transfer to a substrate. As indicated above, these substrates typically comprise wearing apparel, and most notably garments such as T-shirts, shirts, and sweatshirts. However, the heat press machine 10 may also be used to apply heat transfers to other substrates, including towels, hand towels, hats and visors. Typically, any substrate with which the heat press machine 10 is utilized will be fabricated from a cloth or fabric material of natural or synthetic fibers. However, the heat press machine 10 may be used to apply heat transfers to any substrate which is capable of accepting the same, e.g., wood.

The heat press machine 10 of the first embodiment preferably comprises a housing 12 which includes a base section 14 and a top section 16 which are interconnected by a cylindrically configured support post 18. In the preferred embodiment, the top end of the support post 18 is rigidly attached to the top section 16, with the bottom end of the support post 18 being rotatably connected to the base section 14. The rotatable connection of the support post 18 to the base section 14 allows the top section 16 to be rotated or pivoted relative to the base section 14 for reasons which will be discussed in more detail below.

Rigidly attached to the base section 14 of the housing 12 is a lower platen 20 which has a generally square configuration and defines a generally planar top surface 22. Though not shown, the lower platen 20 may include one or more heating elements disposed therein for selectively raising the temperature of the top surface 22 thereof to a desired level.

Figure 2:
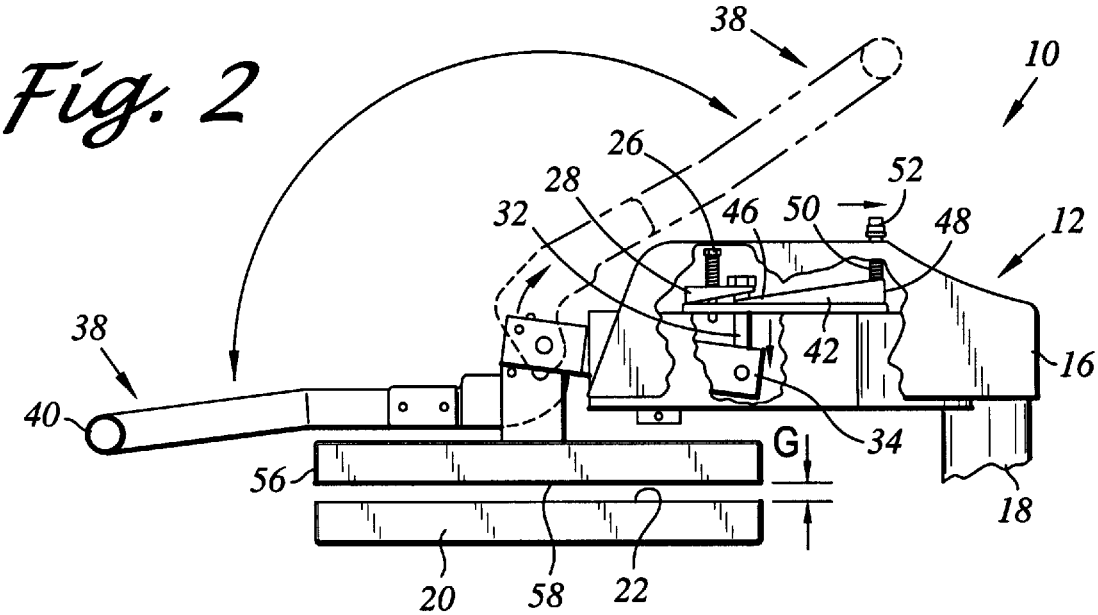
FIG. 2 is a side elevational view of the present heat press machine, illustrating the range of motion of the actuation handle thereof.
Figure 3:
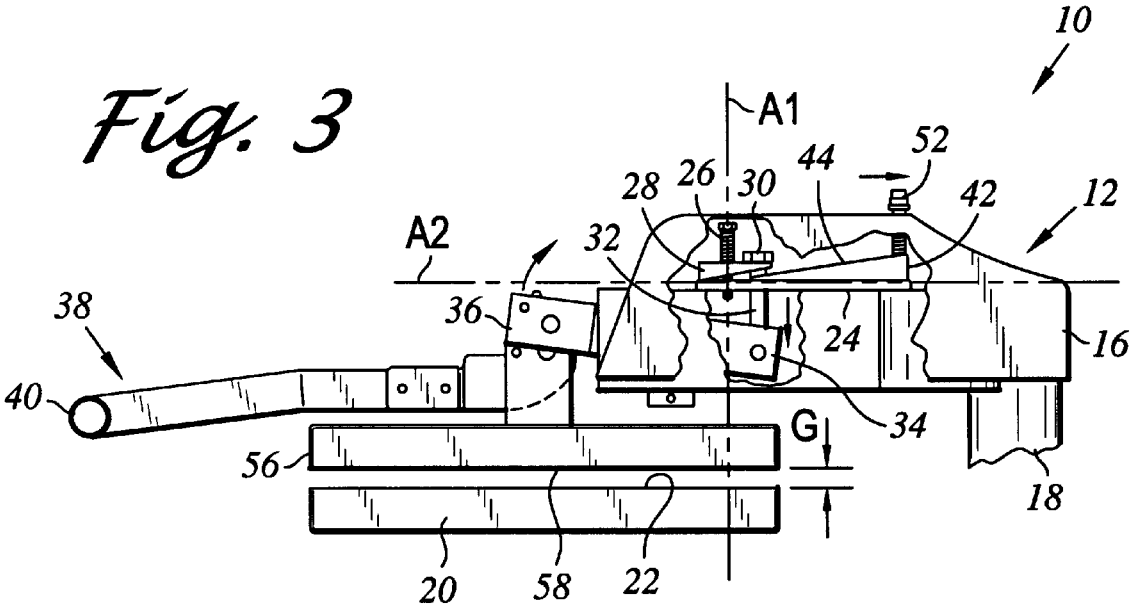
FIG. 3 is a side-elevational view of the present heat press machine, illustrating the relative orientations of various components thereof when adjusted to minimize the amount of compressive pressure which is applicable thereby.
Figure 4:
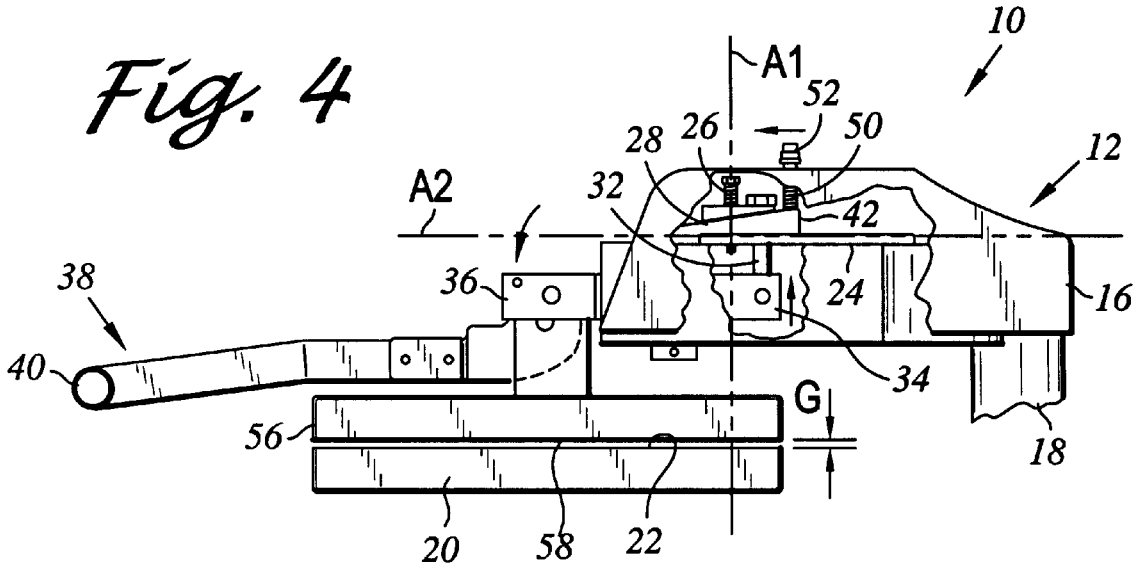
FIG. 4 is a side-elevational view of the present heat press machine, illustrating the relative orientations of various components thereof when adjusted to maximize the level of compressive pressure which is applicable thereby.

Referring now to FIGS. 1–4, disposed within the top section 16 of the housing 12 is a support plate 24. Threadably connected to the support plate 24 adjacent one end thereof is a first fastener 26 which extends generally vertically upwardly (i.e., perpendicularly) from the top surface thereof. As seen in FIGS. 3 and 4, the first fastener 26 defines a vertically oriented or extending first axis A1. In the heat press machine 10, the first fastener 26 extends through a complementary opening formed within a first wedge member 28 which is positioned above the support plate 24 and defines a sloped bottom surface 30. The diameter of the opening within the first wedge member 28 which accommodates the first fastener 26 exceeds the diameter of the shank portion of the first fastener 26, but is less than the diameter of the enlarged head portion of the first fastener 26. As such, the first wedge member 28 is movable upwardly and downwardly relative to the first fastener 26 along the first axis A1 defined thereby, yet is prevented from lifting off of the first fastener 26 by the enlarged head portion thereof, i.e., by the contact between the enlarged head portion of the first fastener 26 and the generally planar top surface of the first wedge member 28.

Attached to the first wedge member 28 is a link fastener 32 which extends through the first wedge member 28 and through a complementary opening disposed within the support plate 24. In this respect, the enlarged head portion of the link fastener 32 is in direct contact with the top surface of the first wedge member 28. Additionally, the opening within the support plate 24 through which the link fastener 32 extends is sized to have a diameter which exceeds the diameter of the shank portion of the link fastener 32, thus allowing the link fastener 32 to be freely movable upwardly and downwardly therewithin. As will be recognized, any movement of the first wedge member 28 upwardly or downwardly along the first axis A1 results in the concurrent movement of the link fastener 32 within the support plate 24.

In the heat press machine 10, the distal end of the link fastener 32 (i.e., the end opposite the head portion thereof) is pivotally connected to one end of an elongate linkage member 34. As best seen in FIG. 1, the end of the linkage member 34 opposite that pivotally connected to the link fastener 32 protrudes from the front of the top section 16 of the housing 12 and defines a pair of ear portions 36 which extend in spaced, generally parallel relation to each other. Pivotally connected to the end of the linkage member 34 opposite that which is pivotally connected to the link fastener 32 is an elongate actuation handle 38. The actuation handle 38 defines a distal end having a perpendicularly extending gripper portion 40, with the opposite end of the actuation handle 38 being inserted between the ear portions 36 of the linkage member 34 and pivotally connected thereto. The actuation handle 38 is selectively movable between a release position (shown in FIG. 1 and in phantom in FIG. 2) and a press position (shown in FIGS. 3 and 4). The functional attributes of the heat press machine 10 corresponding to the movement of the actuation handle 38 between its release and press positions will also be discussed in more detail below.

Slidably positioned upon the top surface of the support plate 24 is the generally planar bottom surface of a second wedge member 42 which also defines a sloped top surface 44. As seen in FIGS. 3 and 4, the second wedge member 42 is slidably movable along the top surface of the support plate 24 back and forth along a horizontally oriented second axis A2 which extends in generally perpendicular relation to the first axis A1. Formed within the second wedge member 42 is an elongate slot which extends from the front, distal edge 46 thereof and terminates inwardly from its back surface 48. The width of this slot slightly exceeds the diameter of the shank portion of the link fastener 32. In this respect, the second wedge member 42 is oriented relative to the first wedge member 28 such that when the second wedge member 42 is moved back and forth along the second axis A2, the slot thereof is always aligned with the shank portion of the link fastener 32. Such alignment allows the second wedge member 42 to be moved along the second axis A2 toward the first wedge member 28 in that the shank portion of the link fastener 32 is received into and therefore accommodated by the slot of the second wedge member 42. Importantly, the shank portion of the first fastener 26 is aligned with the shank portion of the link fastener 32, thus causing the same to also be received into and accommodated by the slot of the second wedge member 42 when the same is slidably advanced along the second axis A2 toward the first wedge member 28.

Attached to the second wedge member 42 in relative close proximity to the back surface 48 thereof is an elongate adjustment handle 50 which extends vertically upwardly therefrom. The top end of the adjustment handle 50 protrudes from the top surface of the top section 16 of the housing 12, and includes a gripper cap 52 attached thereto. The adjustment handle 50 extends through an elongate slot 53 which is disposed within the top section 16 and extends in generally parallel relation to the second axis A2. As will be described below, the adjustment handle 50 is able to linearly travel within the slot 53. Disposed on the top surface of the top section 16 along the slot 53 is indexing indicia 54. The adjustment handle 50 is used to selectively move the second wedge member 42 back and forth along the second axis A2 for reasons which will also be discussed in more detail below.

The heat press machine 10 of the first embodiment further comprises a upper platen 56 which is pivotally connected to the actuation handle 38, and is reciprocally movable by the actuation handle 38 toward and away from the lower platen 20. Like the lower platen 20, the upper platen 56 preferably has a generally square configuration and defines a generally planar bottom surface 58. When the actuation handle 38 is in either its press or release positions, the upper platen 56 is substantially aligned with and disposed in spaced relation to the lower platen 20. Though not shown, disposed within the upper platen 56 is a heating element which is operable to selectively raise the temperature of the bottom surface 56 thereof to a desired level.

As indicated above, the top section 16 of the housing 12 is rotatable or pivotal relative to the base section 14 thereof by virtue of the bottom end of the support post 18 being rotatably connected to the base section 14. As seen in FIG. 1, such rotatability of the top section 16 allows the upper platen 56 and actuation handle 38 to be selectively moved between an operating position and an access position relative to the lower platen 20. When the upper platen 56 and actuation handle 38 are in the operating position, the upper platen 56 is in substantial vertical alignment with and disposed in spaced relation to the lower platen 20 as shown in FIGS. 2–4. Advantageously, the upper platen 56 and actuation handle 38 may be moved to the access position whereat the lower platen 20, and in particular the top surface 22 thereof, is uncovered by the rotational or pivotal movement of the upper platen 56 from thereover. Such rotation of the upper platen 56 is attributable to the rotation of the support post 18 relative to the base section 14, and is preferably accomplished through the utilization of a handle member 60 which is attached to and protrudes from the top section 16 of the housing 12. Due to it rigid attachment to the base section 14, the lower platen 20 remains stationary as the upper platen 56 is moved between its operating and access positions.

Referring now to FIGS. 2–4, when the upper platen 56 is in its operating position and the actuation handle 38 is in its press position, a gap G is normally defined between the bottom surface 58 of the upper platen 56 and the top surface 22 of the lower platen 20. The movement of the actuation handle 38 from its press position to its release position facilitates an increase in the width of the gap G (i.e., an increase in the spacing between the lower and upper platens 20, 56), but does not disrupt the vertical alignment between the lower and upper platens 20, 56. The increase in the width of the gap G attributable to the movement of the actuation handle 38 to its release position allows the upper platen 56 to be rotated from its operating position to its access position without interfering with any substrate positioned upon the top surface 22 of the lower platen 20 subsequent to the adhesion of a heat transfer thereto. However, as indicated above, the gap G will still normally exist between the lower and upper platens 20, 56 when the actuation handle 38 is in its press position.

In the heat press machine 10, the first and second wedge members 28, 42, adjustment handle 50, first fastener 26, link fastener 32, and linkage member 34 collectively comprise an adjustment mechanism of the heat press machine 10 for selectively increasing or decreasing the spacing (i.e., the width of the gap G) between the lower and upper platens 20, 56, and more particularly the top surface 22 and bottom surface 58 thereof. In this respect, the first and second wedge members 28, 42 are oriented upon the support plate 24 relative to each other such that the horizontal movement of the second wedge member 42 along the second axis A2 results in the concurrent vertical movement of the first wedge member 28 along the first axis A1. More particularly, as seen in FIG. 4, the movement of the second wedge member 42 along the second axis A2 toward the first wedge member 28 results in the upward movement of the first wedge member 28 along the first axis A1. Such upward movement is attributable to the interference between the complementary sloped surfaces of the first and second wedge members 28, 42, and more particularly the bottom surface 30 of the first wedge member 28 and the top surface 44 of the second wedge member 42. As will be recognized, the greater the movement of the second wedge member 42 along the second axis A2 toward the first wedge member 28, the greater the movement of the first wedge member 28 upwardly along the first axis A1 away from the support plate 24.

As further seen in FIG. 4, the upward movement of the first wedge member 28 along the stationary first fastener 26, and hence the first axis A1, results in the concurrent upward vertical movement of the link fastener 32 which, as previously explained, is rigidly attached to the first wedge member 28. The upward movement of the link fastener 32 in turn results in the rotational movement of the linkage member 34 in a generally counter-clockwise direction as viewed from the perspective shown in FIG. 4. Such rotation of the linkage member 34 effectively lowers the level of the actuation handle 38 which is pivotally connected thereto, and hence decreases the width of the gap G between the bottom surface 58 of the upper platen 56 and the top surface 22 of the lower platen 20 (i.e., a decrease in the spacing between the upper and lower platens 56, 20).

Conversely, the movement of the second wedge member 42 along the second axis A2 away from the first wedge member 28 results in the downward movement of the first wedge member 28 along the first fastener 26, and hence the first axis A1. As previously explained, the movement of the second wedge member 42 along the second axis A2 relative to the shank portions of the first fastener 26 and link fastener 32 is made possible by the inclusion of the slot within the second wedge member 42. As seen in FIG. 3, the downward movement of the first wedge member 28 along the first axis A1 results in the concurrent downward vertical movement of the link fastener 32. The downward movement of the link fastener 32 in turn results in the clockwise rotation of the linkage member 34 as viewed from the perspective shown in FIG. 3. Such rotation of the linkage member 34 effectively raises the level of the actuation handle 38 which is pivotally connected thereto, and hence increases the width of the gap G defined between the bottom surface 58 of the upper platen 56 and the top surface 22 of the lower platen 20 (i.e., increases the spacing between the upper and lower platens 56, 20). When the second wedge member 42 is slidably moved along the second axis A2 to its point of maximum separation from the first wedge member 28, the bottom surface 30 of the first wedge member 28 will still typically be in contact with the top surface 44 of the second wedge member 42.

As will be recognized by those of ordinary skill in that art, an increase in the spacing between the upper and lower platens 56, 20 effectively decreases the level of compressive pressure applied by the upper platen 56 to any substrate and heat transfer disposed between the upper and lower platens 56, 20 when the actuation handle 38 is moved to its press position. Conversely, a decrease in the spacing between the upper and lower platens 56, 20 effectively increases the level of compressive pressure applied by the upper platen 56 to any substrate and heat transfer between the upper and lower platens 56, 20 when the actuation handle 38 is moved to its press position. Typically, the desired level of compressive pressure is function of the relative thicknesses of the substrate and the heat transfer. In this respect, a thicker substrate will typically compel an increase in the spacing between the upper and lower platens 56, 20 (i.e., an increase in the width of the gap G) such that the movement of the actuation handle 38 to its press position does not result in the heat transfer being smashed into the substrate. In contrast, a relatively thin substrate will typically compel a reduction in the spacing between the upper and lower platens 56, 20 (i.e., a decrease in the width of the gap G) such that adequate compressive pressure is applied thereto by the movement of the actuation handle 38 to its press position as is needed to facilitate the proper adhesion of the heat transfer to the substrate. As will be recognized, the movement of the second wedge member 42 back and forth along the second axis A2 is facilitated by the adjustment handle 50. Advantageously, the indexing indicia 54 disposed upon the top section adjacent the slot 53 provides a visual reading which is correlated to the spacing between the upper and lower platens 56, 20.

The heat press machine 10 of the first embodiment is preferably used by initially moving the upper platen 56 from its operating position to its access position, and thereafter placing a substrate and a heat transfer onto the top surface 22 of the lower platen 20. Subsequent to the movement of the upper platen 56 back to its operating position, the spacing between the upper and lower platens 56, 20 is adjusted via the adjustment mechanism in the above-described manner based on the desired level of compressive pressure to be applied to the substrate and to the heat transfer. Prior to or during the adjustment in the spacing between the upper and lower platens 56, 20, the upper platen 56, alone or in combination with the lower platen 20, is heated by the associated heating element(s).

After the spacing between the upper and lower platens 56, 20 has been properly adjusted, the actuation handle 38 is moved from its release position to its press position to facilitate the application of compressive pressure to the heat transfer and the substrate by the upper platen 56. Thereafter, the actuation handle 38 is returned to its release position, with the upper platen 56 then being moved from its operating position to its access position so as to allow the substrate having the heat transfer adhered thereto to be removed from upon the lower platen 20.

Figure 5:
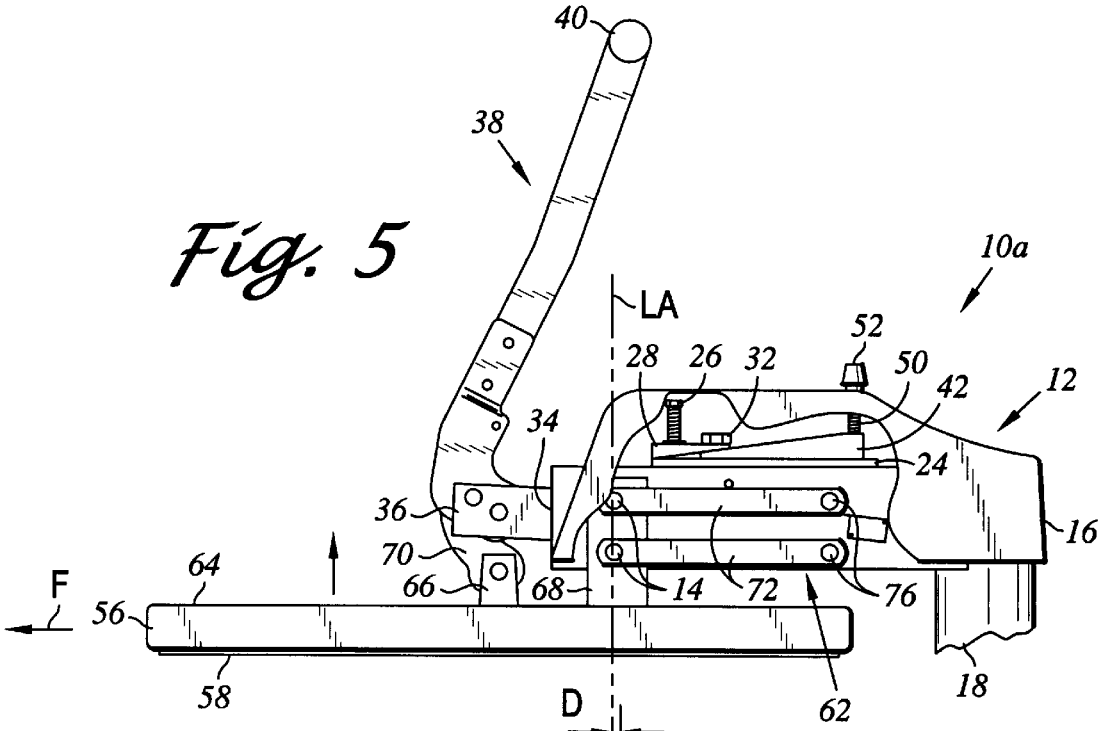
FIG. 5 is a side-elevational view of a heat press machine constructed in accordance with a second embodiment of the present invention, illustrating the relative orientations of various components thereof including the linkage mechanism when the actuation handle is in its release position.
Figure 6:
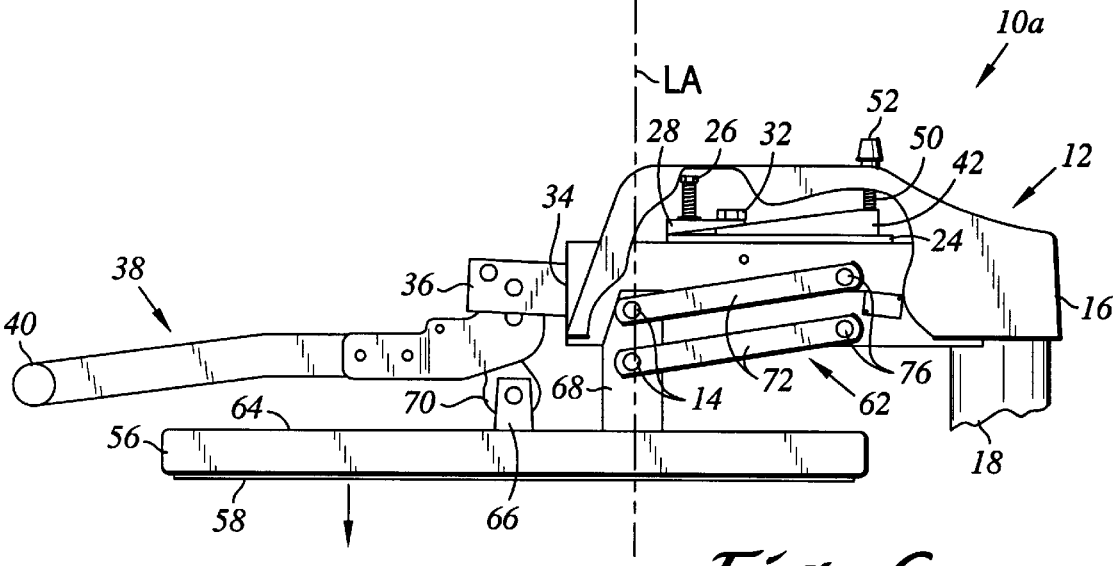
FIG. 6 is a side-elevational view of the heat press machine of the second embodiment, illustrating the relative orientations of various components thereof including the linkage mechanism when the actuation handle is in its press position.

Referring now to FIGS. 5 and 6, there is depicted a heat press machine 10*a* constructed in accordance with a second embodiment of the present invention. The heat press machine 10*a* is substantially similar both structurally and functionally to the heat press machine 10 of the first embodiment, with the primary structural differences involving a modified method of attaching the upper platen 56 to the actuation handle 38 in the heat press machine 10*a*, and the inclusion therein of a linkage mechanism 62 which maintains the upper platen 56 in substantial vertical alignment with the lower platen 20 during movement of the actuation handle 38 between its press and release positions.

In the heat press machine 10*a*, attached to and extending upwardly from the approximate center of the top surface 64 of the upper platen 56 is a handle stub 66. Also attached to and extending upwardly from the top surface 64 rearward from the handle stub 66 is an anchor member 68. As such, the anchor member 68 is disposed between the handle stub 66 and that edge of the upper platen 56 which is disposed furthest from the gripper portion 40 of the actuation handle 38 when the same is in its press position.

In the heat press machine 10*a* of the second embodiment, the upper platen 56 is pivotally connected to the actuation handle 38 via a cam member 70 which extends therebetween. More particularly, the cam member 70 includes an upper portion which is pivotally connected to the actuation handle 38 and disposed between the ear portions 36 defined by the linkage member 34. In addition to the upper portion, the cam member 70 includes a lower portion which is pivotally connected to the handle stub 66 protruding upwardly from the top surface 64 of the upper platen 56. The pivotal connection of the upper platen 56 to the actuation handle 38 via the cam member 70 maintains the bottom surface 58 of the upper platen 56 in substantially parallel relation to the top surface 22 of the lower platen 20 when the actuation handle 38 of the heat press machine 10*a* is moved between its release position (shown in FIG. 5) and its press position (shown in FIG. 6). It will be recognized that the cam member 70 can also be employed in the heat press machine 10 of the first embodiment to facilitate the pivotal connection of the upper platen 56 to the actuation handle 38.

Due to the inclusion of the pivoting or rotating cam member 70 within the heat press machine 10*a*, the movement of the actuation handle 38 between its release and press positions has a tendency to result in a slight forward movement of the upper platen 56 relative to the lower platen 20 in the direction of the arrow F shown in FIG. 5. As will be recognized, any such slight forward movement of the upper platen 56 results in the same being brought out of substantially complete vertical alignment with the lower platen 20 when the actuation handle 38 is moved from its release position to its press position. As indicated above, such forward "shifting" of the upper platen 56 as the substrate is being compressed between the upper and lower platens 56, 20 during movement of the actuation handle 38 to its press position could result in a disruption in the process of applying the heat transfer to the substrate (e.g., a lack of proper adhesion between the heat transfer and the substrate).

In the heat press machine 10*a* of the second embodiment, the upper platen 56 is maintained in substantially precise vertical alignment with the lower platen 20 during the movement of the actuation handle between its press and release positions due to the inclusion of the linkage mechanism 62 therein. The linkage mechanism 62 comprises a pair of identically configured elongate strut members 72, the front ends of which are pivotally connected to the anchor member 68 via respective ones of a pair of fasteners 74 such as pivot pins. As seen in FIG. 5, the front ends of the strut members 72 are pivotally connected to the anchor member 68 such that the fasteners 74 are disposed in vertical alignment along a linkage axis LA. The back ends of the strut members 72 are themselves pivotally connected to the top section 16 of the housing 12 via respective ones of a pair of fasteners 76 such as pivot pins.

As further seen in FIGS. 5 and 6, due to the configuration of the linkage mechanism 62, and more particularly the manner in which the strut members 72 are cooperatively engaged to the upper platen 56 and housing 12, the movement of the actuation handle 38 from its release position (shown in FIG. 5) to its press position (shown in FIG. 6) results in the linkage axis LA being shifted or offset slightly rearwardly by the distance D. As will be recognized, this rearward shifting of the linkage axis LA occurs as a result of the rearward movement of the fasteners 74 by the distance D, which in turn results in the rearward movement of the anchor member 68 and upper platen 56 the same distance D. The pivotal connection of the upper platen 56 to the actuation handle 38 via the handle stub 66 and cam member 70 allows for the rearward shifting of the upper platen 56 by the distance D upon the movement of the actuation handle 38 to its press position.

In the heat press machine 10*a*, the rearward shifting of the linkage axis LA, and hence the upper platen 56, by the distance D negates the forward movement of the upper platen 56 in the direction of the arrow F attributable to the cam member 70 during the movement of the actuation handle 38 between its release and press positions, thus always maintaining the upper and lower platens 56, 20 in substantial vertical alignment to each other despite the movement of the upper platen 56 relative to the stationary lower platen 20. By substantial vertical alignment, it is meant that the peripheral edges of the upper and lower platens 20, 56 are maintained in substantially co-planar relation to each other as the upper platen 56 is moved upwardly and downwardly relative to the lower platen 20. During the actuation of the linkage mechanism 62 as occurs when the actuation handle 38 is moved between its press and release positions, the strut members 72 are always maintained in spaced, generally parallel relation to each other.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A manually actuated heat press machine for applying a heat transfer to a substrate, the machine comprising:

a housing;

a lower platen attached to the housing;

an actuation handle pivotally connected to the housing and selectively movable between a press position and a release position relative thereto;

an upper platen attached to the actuation handle and reciprocally movable thereby toward and away from the lower platen, the upper platen being substantially aligned with and disposed in spaced relation to the lower platen when the actuation handle is in the press position; and a linkage mechanism cooperatively engaged to the housing and to the upper platen for maintaining the upper platen in substantial alignment with the lower platen when the actuation handle is moved between the press and release positions;

the housing being configured such that the upper platen and the actuation handle are pivotally movable between an operating position and an access position relative to the lower platen the upper platen being substantially aligned with the lower platen when in the operating position.

2. The machine of claim 1 wherein the linkage mechanism comprises at least one elongate strut member having a first end pivotally connected to the housing and a second end pivotally connected to the upper platen.

3. The machine of claim 2 wherein the at least one strut member comprises a pair of strut members which are maintained in spaced, generally parallel relation to each other during movement of the actuation handle between the press and release positions.

4. The machine of claim 1 further comprising:

an adjustment mechanism cooperatively engaged to the actuation handle for selectively adjusting the spacing between the upper and lower platens when the actuation handle is in the press position;

wherein a decrease in the spacing between the upper and lower platens effectively increases the level of compressive pressure applied to any substrate and heat transfer therebetween when the actuation handle is moved to the press position, and an increase in the spacing between the upper and lower platens effectively decreases the level of compressive pressure applied to any substrate and heat transfer therebetween when the actuation handle is moved to the press position.

5. The machine of claim 4 wherein the adjustment mechanism comprises:

a first wedge member movably attached to the housing and selectively moveable along a first axis relative thereto;

a second wedge member movably attached to the housing and selectively movable along a second axis relative thereto which extends in generally perpendicular relation to the first axis; and a linkage member pivotally connected to the first wedge member and to the actuation handle;

the first and second wedge members being oriented relative to each other such that the movement of the second wedge member along the second axis results in the concurrent movement of the first wedge member along the first axis.

6. The machine of claim 5 wherein:

the first axis is generally vertically oriented;

the second axis is generally horizontally oriented; and the movement of the second wedge member along the second axis toward the first wedge member results in the upward movement of the first wedge member along the first axis and a decrease in the spacing between the upper and lower platens, and the movement of the second wedge member along the second axis away from the first wedge member results in the downward movement of the first wedge member along the first axis and an increase in the spacing between the upper and lower platens.

7. The machine of claim 6 wherein the first and second wedge members are disposed within the housing, and the second wedge member includes an adjustment handle which is attached thereto and protrudes from the housing for facilitating the movement of the second wedge member along the second axis.

8. The machine of claim 7 wherein the housing includes indexing indicia disposed thereon adjacent the adjustment handle for providing a visual reading which is correlated to the spacing between the upper and lower platens.

9. The machine of claim 1 wherein the lower platen defines a generally planar top surface and the upper platen defines a generally planar bottom surface.

10. The machine of claim 9 wherein the upper and lower platens each have generally square configurations.

11. A manually actuated heat press machine for applying a heat transfer to a substrate, the machine comprising:

a housing;

a lower platen attached to the housing;

an actuation handle pivotally connected to the housing and selectively movable between a press position and a release position relative thereto;

an upper platen attached to the actuation handle and reciprocally movable thereby toward and away from the lower platen, the upper platen being substantially aligned with and disposed in spaced relation to the lower platen when the actuation handle is in the press position;

a linkage mechanism cooperatively engaged to the housing and to the upper platen for maintaining the upper platen in substantial alignment with the lower platen when the actuation handle is moved between the press and release positions; and an adjustment mechanism cooperatively engaged to the actuation handle for selectively adjusting the spacing between the upper and lower platens when the actuation handle is in the press position, the adjustment mechanism comprising:

a first wedge member movably attached to the housing and selectively movable along a first axis relative thereto;

a second wedge member movably attached to the housing and selectively movable along a second axis relative thereto which extends in generally perpendicular relation to the first axis; and a linkage member pivotally connected to the first wedge member and to the actuation handle;

the first and second wedge members being oriented relative to each other such that the movement of the second wedge member along the second axis results in the concurrent movement of the first wedge member along the first axis;

wherein a decrease in the spacing between the upper and lower platens effectively increases the level of compressive pressure applied to any substrate and heat transfer therebetween when the actuation handle is moved to the press position, and an increase in the spacing between the upper and lower platens effectively decreases the level of compressive pressure applied to any substrate and heat transfer therebetween when the actuation handle is moved to the press position.

12. The machine of claim 11 wherein the linkage mechanism comprise at least one elongate strut member having a first end pivotally connected to the housing and a second end pivotally connected to the upper platen.

13. The machine of claim 12 wherein the at least one strut member comprises a pair of strut members which are maintained in spaced, generally parallel relation to each other during movement of the actuation handle between the press and release positions.

14. The machine of claim 11 wherein:

the first axis is generally vertically oriented;

the second axis is generally horizontally oriented; and the movement of the second wedge member along the second axis toward the first wedge member results in the outward movement of the first wedge member along the first axis and a decrease in the spacing between the upper and lower platens, and the movement of the second wedge member along the second axis away from the first wedge member results in the downward movement of the first wedge member along the first axis and an increase in the spacing between the upper and lower platens.

15. The machine of claim 14 wherein the first and second wedge members are disposed within the housing, and the second wedge member includes an adjustment handle which is attached thereto and protrudes from the housing for facilitating the movement of the second wedge member along the second axis.

16. The machine of claim 15 wherein the housing includes indexing indicia disposed thereon adjacent the adjustment handle for providing a visual reading which is correlated to the spacing between the upper and lower platens.

17. The machine of claim 11 wherein the housing is configured such that the upper platen and the actuation handle are pivotally movable between an operating position and an access position relative to the lower platen, the upper platen being substantially aligned with the lower platen when in the operating position.

18. The machine of claim 11 wherein the lower platen defines a generally planar top surface and the upper platen defines a generally planar bottom surface.

19. The machine of claim 18 wherein the upper and lower platens each have generally square configurations.

* * * * *